United States Patent [19]

Hardt

[11] Patent Number: 5,012,740

[45] Date of Patent: May 7, 1991

[54] ELECTRORHEOLOGICALLY DAMPED IMPACT SYSTEM

[75] Inventor: Lee R. Hardt, Ridgecrest, Calif.

[73] Assignee: The United States of America as represented by the Secretary of the Navy, Washington, D.C.

[21] Appl. No.: 461,566

[22] Filed: Jan. 5, 1990

[51] Int. Cl.[5] ..... F42C 19/06

[52] U.S. Cl. ..... 102/216

[58] Field of Search ..... 102/216, 262–264; 200/61.45

[56] References Cited

U.S. PATENT DOCUMENTS

| | | | |
|---|---|---|---|
| 3,054,870 | 9/1962 | Wagoner | 102/216 |
| 3,205,321 | 9/1965 | Lyon | 102/264 |
| 4,715,281 | 12/1987 | Dinger et al. | 102/216 |

*Primary Examiner*—Charles T. Jordan

*Attorney, Agent, or Firm*—Harvey A. Gilbert; Melvin J. Sliwka; Sol Sheinbein

[57] ABSTRACT

An impact switch having a housing containing a rigid coaxial conductor entering one end. An inner cylindrical contact extends axially inward from and beyond the in housing end of an outer tubular contact which has a spiral spring extending axially from within a recess therein. The free end of the spring supports a mass spaced from the end of the inner contact. The contacts, spring and mass are enclosed within a flexible shroud spaced from the inner wall of the housing. The space between the shroud and housing contains an electrorheological fluid, the viscosity of which is a function of the voltage supplied by two electrodes extending through the housing and into the fluid. The voltage controlled viscosity permits control of damping of the shroud, mass, and spring movements in response to impact caused switch deceleration and control of time for switch closure and fuze delay by means of mass contact with the inner cylindrical contact, or spring contact with the outer tubular contact.

18 Claims, 1 Drawing Sheet

ELECTRORHEOLOGICALLY DAMPED IMPACT SYSTEM

BACKGROUND OF THE INVENTION

1. Field of the Invention

The present invention relates to the field of switches for electrical circuits. In particular the present invention relates to an electrical switch which is capable of closing an electrical circuit only when the switch itself is subject to the effects of deceleration.

2. Description of the Prior Art

A variety of impact switches designed for use in conjunction with ordnance devices are known in the prior art. Such switches are designed to react to the effects of deceleration when the ordnance device which carries the switch impacts a particular target. The effect of deceleration upon the switch when the ordnance device impacts results in action within the switch which causes it to close the circuit in which it is located. The ordnance device thus becomes fuzed or armed and explosive actions follow. Typical of prior art impact switches are those known as spring mass devices, piezoelectric sensors, and crush sensors. Each of these types of devices for detecting impact and either completing the circuit or sending a signal for use in fuzing the ordnance device can be found in a variety of different configurations. Spring mass devices in the prior art are all found to be susceptible to bullet impact. None of these devices offer variable sensitivity. The piezoelectric sensors are also susceptible to bullet impact and like the spring mass devices do not offer variable sensitivity. Crush sensors again do not offer variable sensitivity regardless of their configurations in the prior art. What is needed is a simple, reliable device for sensing the impact of an ordnance item with its target and which is insensitive to bullet or other shrapnel impact during the course of the flight of the ordnance device and which offers variable sensitivity. That is what is desired is a device the sensitivity of which can be adjusted in some way so that the time between the time of impact and the time of sending out either a signal or closing a circuit for ordnance device fuzing can be adjusted either by virtue of the inherent design of the device, that is, device selection or by means of a variable element that permits external adjustment prior to use. The need for variable sensitivity of the sensor or switch to the impact is a result of the necessity for permitting the ordnance device to impact the target and in fact penetrate it prior to the ordnance device being fuzed and exploded. Thus, the impact sensor or switch most desirably should have some means of controlling its reaction time.

SUMMARY OF THE INVENTION

It is thus an object of the present invention to provide an impact switch having variable sensitivity to impact by or with another object.

It is another object of the present invention to provide a simplified means of variable detonation delay after impact of an impact switch triggered detonator.

It is yet another object of the present invention to provide a built-in method of inhibiting warhead detonation which avoids countermeasures.

It is still another object of the present invention to optimize target damage by providing detonation delay as a function of the target rather than as a function of time.

It is finally an object of the present invention to provide a more omnidirectional impact switch sensitivity than possible by means of rigid damping.

The present invention is an electro-mechanical switch which uses a spring supported mass to sense deceleration upon the impact of the ordnance device carrying the present invention with the target. The spring supporting the mass is physically and electrically connected to one contact of the switch connected to one side of a detonator circuit in a close relationship spatially with the contact of the switch connected to the other side of the detonator circuit. The mass and spring assembly along with the contacts are contained within a flexible shroud which is in turn contained within and spaced from a housing that encloses the entire assembly and protects it environmentally. The space between the housing and the shroud containing the spring, the mass, and the two contacts to the two opposite sides of the detonator circuit to which the switch is connected contains an electrorheological fluid. This fluid can be prepared in a variety of formulations, all of which, however, have the property that their viscosity can be varied as a function of applied voltage to the fluid. Thus, two additional electrical connections to the switch of the present invention extend through the outer housing of the device and into the fluid between the housing and the shroud. A voltage can then be applied to the fluid during its use to vary its viscosity. Thus, depending upon how the device is fabricated, the voltage applied to the fluid can be set in the field prior to use so that the rheological fluid viscosity is set to provide the desired damping action within the switch in relation to the spring suspended mass. This permits control of the amount of time between impact and the effects of deceleration upon the present invention before circuit closure by the switch occurs. Thus, the present invention has the ability to have its reaction time for closing a circuit after impact varied to permit varying degrees of penetration of the target by the ordnance device prior to switch closer which sets off the explosive charge of the ordnance device.

In addition to varying the composition of the electrorheological fluid employed in the switch of the present invention to vary its reaction time to the deceleration affects of the ordnance device impact with the target, the voltage applied to the fluid can be varied to affect its damping characteristics.

Another advantage of the switch of the present invention is that it can sense and react to the deceleration affects of ordnance device impact with the target in any direction. This will be understood further and will be easily seen in the description in detail which follows.

BRIEF DESCRIPTION OF THE DRAWINGS

Other objects, advantages, and features of the present invention will be apparent from the following detailed description when considered in conjunction with the accompanying drawings in which.

DETAILED DESCRIPTION OF THE INVENTION

Figure 1:
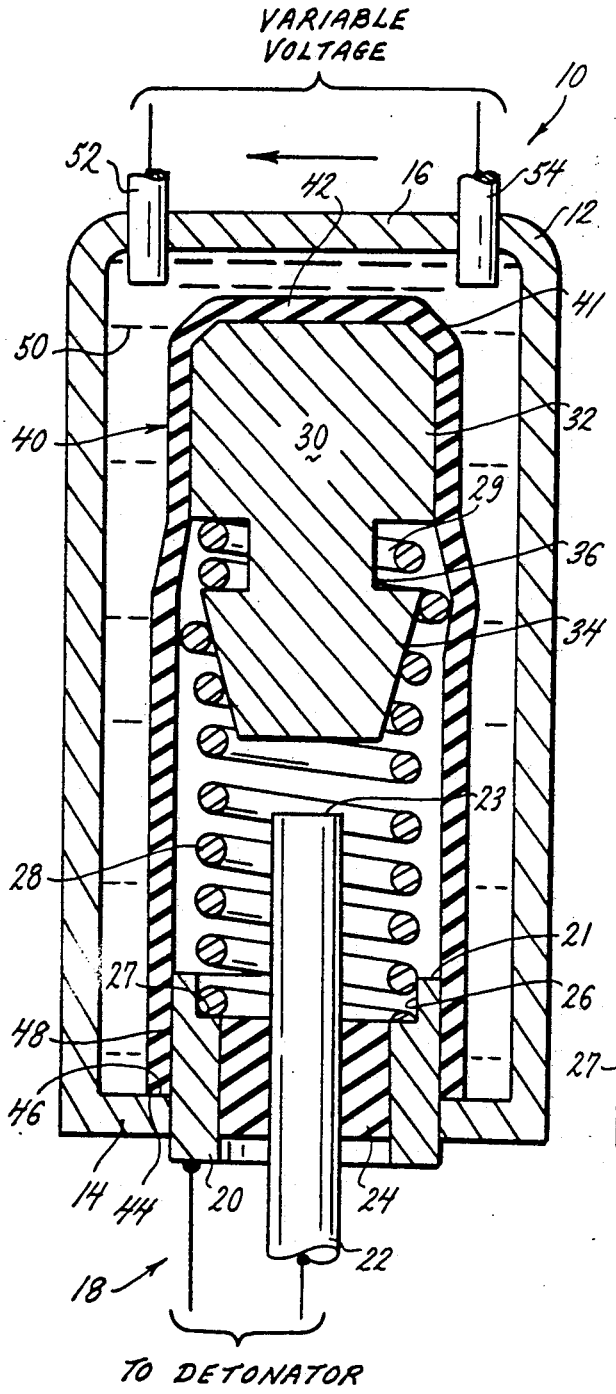
FIG. 1 is a side sectional view of the device of the present invention when it is at rest and not subject to the effects of impact caused deceleration.

With reference to FIG. 1 the impact switch 10 is shown comprised of the housing 12 which has an open end 14 and a closed end 16. The rigid coaxial conductor 18 consisting of the outer tubular contact 20, the inner cylindrical contact 22, and the insulative rigid seal 24 is shown extending into from outside the housing 12 through the open end 14 of the housing 12. The outer tubular contact 20 has a cylindrically shaped recess 26 extending from the inner end 21 of the outer tubular contact 20 to the bottom 27 of the cylindrically shaped recess 26. The inner cylindrical contact 22 extends beyond the end 21 of the outer tubular contact 20 axially into the housing 12.

The spiral spring contact 28 has one end which extends from within and in contact with the cylindrically shaped recess 26 in the outer tubular contact 20. The opposite end of the spiral spring contact 28 extends coaxially about and beyond the end 23 of the inner cylindrical contact 22.

The mass 30 which has a top 32, a bottom 34, and the neck 36 extending between the top 32 and the bottom 34 is introduced into the end 29 of spiral spring contact 28 until the complete bottom 34 of the mass 30 extends within the spring contact 28 to the point that the end 29 of the spring contact 28 is securely constrained about the neck 36. The mass 30 is thus held by the spring contact 28 at a distance above the end 23 of the inner cylindrical contact 22. The mass 30 being thus in contact with the spring contact 28 which is in turn in contact with the outer tubular contact 20 constitutes a continuous contact to one side of an external circuit with the inner cylindrical contact 22 being the contact to the other side of that circuit. The external circuit in this case is typically a detonator fuzing circuit for an explosive in an ordnance device.

The flexible shroud 40 has a closed end 42 with a champfered area 41 about its closed end 42 and an open end 44 which extends completely about and around the mass 30, the spring contact 28, the outer tubular contact 20, and the inner cylindrical contact 22. The open end 44 of the flexible shroud 40 is affixed to the inner surface 46 of open end 44 of the housing 12 with which it abuts and to the outer surface 48 of the outer tubular contact 20 with which its inner surface is in mating contact.

A rheological fluid 50 fills the space between flexible shroud 40 and housing 12. At the closed end 16 of the housing 12, an electrode 52 spaced from a second electrode 54 extends from outside the housing 12 into the rheological fluid 50 and supplies a variable voltage from an external source. A voltage in the kilovolt range is connected between electrode 52 and electrode 54 to supply the voltage to which the rheological fluid 50 is known to react. The voltage supplied is dependent upon the particular rheological fluid selected for the particular application. The effect of the voltage on the rheological fluid 50 is to cause the fluid to change in viscosity. Viscosity of the rheological fluid 50 is dependent upon both the composition of the fluid and the voltage applied to the fluid. Thus by an appropriate selection of electrorheological fluid 50 and voltage to be applied to it one can affect the damping of the components of the impact switch 10 within the flexible shroud 40 to satisfy the demands of the particular application.

The housing 12 can be fabricated from aluminum or nickel. The electrodes 52 and 54 that extend into the housing 12 and into the rheological fluid 50 can be fabricated from conductors appropriately insulated from the housing 12 as they extend through it. The spring contact 28 can be fabricated from beryllium copper in order to assure good conductivity. The mass 30 may be fabricated from copper with gold plating added to assure maximum conductivity. The insulative rigid seal 24 between the inner cylindrical contact 22 and the outer tubular contact 20 may be a rubber-like or epoxy compound. The shroud 40 may be fabricated by a rubber-like impermeable material compatible with the electrorheological fluid selected and the means selected for bonding the shroud 40 to the inner surface 46 of the housing 12 and the outer surface 48 of the outer tubular contact 20. Materials required for fabrication of the present invention may, of course, be selected for a particular application environment.

OPERATION

Figure 2:
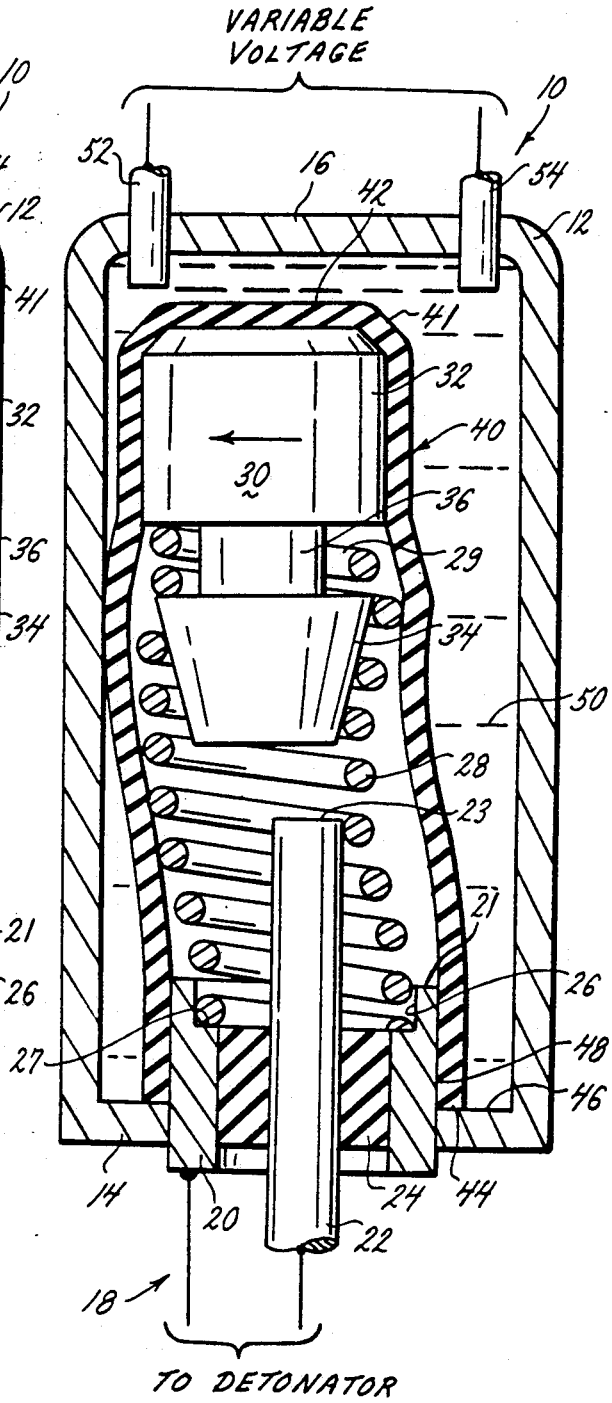
FIG. 2 is a side sectional view of the device of the present invention showing the movement of the internal elements of the device as a result of deceleration occurring upon the impact of the ordnance device with its target.

The operation of the impact switch 10 can be more easily understood by reference to both FIGS. 1 and 2. The impact switch 10 can be mounted so that it can react to deceleration forces directed laterally, or across its longitudinal axis, as seen in FIG. 2. The impact switch 10 can also be mounted so it can react to deceleration forces transmitted in the direction of its longitudinal axis.

If the impact switch 10 mounted to an ordnance device such that on impact with a target the switch reacts to deceleration forces directed laterally or across its longitudinal axis, the internal result on the impact switch 10 will be as depicted in FIG. 2. The impact switch 10 and all the elements contained therein will be traveling at the time of impact at the same velocity as the ordnance device. The spring supported mass 30 within the impact switch 10 will continue to move under the influence of the damping caused by the electrorheological fluid in the direction of travel of the ordnance device before impact, while the immovable components of the impact switch 10, such as the housing 12, the outer tubular contact 20 and inner cylindrical contact 22 will virtually instantly decelerate at time of impact. The effect of the continued but dampened movement of the mass 30 in the direction of the ordnance device travel relative and subsequent to the sudden deceleration of the housing 12 and the internal components affixed thereto is such that the mass 30 and the attached spring contact 28 move against the flexible shroud 40 within the rheological fluid 50 until the conductive spring contact 28 makes contact with the inner cylindrical contact 22, as shown in FIG. 2. The two sides of the external circuit to the detonator of the ordnance device are thus connected within the impact switch 10.

Where the impact switch 10 is mounted to the ordnance device with the longitudinal axis of the impact switch 10 in line with the direction of travel, upon impact the housing 12 and the rigidly affixed inner cylindrical contact 22 will decelerate to a stop virtually instantaneously while the mass 30 continues to travel subject to the damping effects of the electrorheological fluid 50 in the direction of travel of the ordnance device. At a point in time after impact of the ordnance device with the target the mass 30 will make contact with the end 23 of the inner cylindrical contact 22 thus closing the circuit to the external detonator circuit. The time it takes for the mass 30 to make contact with the end 23 of the inner cylindrical contact 22 will of course be dependent upon the combination of the force required to compress the spring contact 28 and the viscous damping affects of the electrorheological fluid 50. For a particular application it is thus only necessary to select a spring contact 28 having a spring constant and an electrorheological fluid 50 having a viscosity that will, in combination, give the desired amount of time delay to permit penetration of the ordnance device into the particular target before the detonator circuit is completed and detonation of the ordnance device occurs.

It should be obvious that many modifications and variations of the present invention are possible as indicated in the above description of the invention. It should, therefore, be understood that within the scope of the following claims the invention may be practiced in other ways than as specifically described.

What I now claim as my invention is:

1. An acceleration activated impact switch, comprising:

an elongated housing;

a rigid coaxial conductor axially and sealably extending into and through one end of said housing, said conductor having an outer tubular shaped contact having a cylindrical recess in its end inside said housing, an inner cylindrical contact extending beyond the end of said tubular contact in said housing, and a tubular-shaped insulative seal between said inner and outer contacts, said seal extending between the end of said outer contact outside said housing to the bottom of said recess;

a mass, an electrically conductive elastic means affixed to and coaxially extending from within said recess, about and to a point beyond the end of said inner contact, said elastic means for retaining said mass spaced from and in movable relation to said inner cylindrical contact, and for making contact with said inner cylindrical contact;

a flexible means having a movable portion and an immovable portion, said flexible means for enclosing said contacts and mass movably within and spaced from said housing, said movable portion enclosing said contacts and said mass, and said immovable portion affixed to the outer surface of said outer contact and abutting the inner surface of said housing proximate to said coaxial conductor entry;

a voltage activated fluid means for damping movement of said mass within said housing, said fluid means occupying the space between the outside of said flexible means and the inside of said housing; and a means extending through said housing and into said fluid means for applying a voltage to said fluid means.

2. The acceleration activated impact switch of claim 1 wherein said electrically conductive elastic means for retaining said mass and for making contact with said inner cylindrical contact is a spiral spring.

3. The acceleration activated impact switch of claim 1 wherein said flexible means for enclosing said contacts and mass is a flexible shroud.

4. The acceleration activated impact switch of claim 3 wherein said flexible shroud has a closed end disposed snugly about the mass extending from said spring, said shroud extending axially about the length of said spring, and having an open end affixed sealably about the outer surface of said outer tubular contact and abutting the inner surface of the open end of said housing.

5. The acceleration activated impact switch of claim 4 wherein said voltage activated fluid means for damping movement of said mass within said housing is a rheological fluid.

6. The acceleration activated impact switch of claim 5 wherein said means for applying a voltage to said fluid is a pair of spaced electrodes.

7. The acceleration activated impact switch, comprising:

an elongated housing;

a rigid coaxial conductor axially and sealably extending into and through one end of said housing, said conductor having an outer, tubular-shaped contact having a cylindrical recess in its end inside said housing, an inner cylindrical contact extending beyond the end of said tubular contact in said housing, and a tubular-shaped insulative seal between said inner and outer contacts, a spiral spring contact affixed within and extending from said recess axially within said housing;

a mass fixedly disposed at the end of said spring contact and spaced from the end of said inner cylindrical contact opposite the end affixed within said recess;

a flexible means for enclosing said contacts and mass movably within and spaced from said housing, said means affixed to the outer surface of said outer contact and abutting the inner surface of said housing proximate to said coaxial conductor entry;

a voltage activated fluid means for damping movement of said mass within said housing, said means occupying the space between the outside of said shroud and the inside of said housing; and a means extending through said housing and into said fluid means for applying a voltage to said fluid.

8. The acceleration activated impact switch of claim 7 wherein said flexible means for enclosing said contacts and mass is a flexible shroud.

9. The acceleration activated impact switch of claim 8 wherein said flexible shroud has a closed end disposed snugly about the mass extending from said spring, said shroud extending axially about the length of said spring, and having an open end affixed sealably about the outer surface of said outer tubular contact and abutting the inner surface of the open end of said housing.

10. The acceleration activated impact switch of claim 9 wherein said voltage activated fluid means for damping movement of said mass within said housing is a rheological fluid.

11. The acceleration activated impact switch of claim 10 wherein said means for applying a voltage to said fluid is a pair of spaced electrodes.

12. An acceleration activated impact switch, comprising:

an elongated housing;

a tubular outer contact extending axially and sealably through one of two ends of said housing, the end of said contact inside said housing having a centered cylindrically shaped recess extending axially therein;

an electrically insulative means for sealing the end of said tubular contact opposite said recess, said means having a centrally located cylindrical hole extending therethrough, a rigid cylindrical inner contact extending sealably through said hole in said means for sealing coaxial with said outer tubular contact, and beyond the end thereof containing said cylindrical recess;

an electrically conductive spiral spring contact affixed conductively to and extending from the recess in said outer tubular contact and coaxially about and beyond the end of said inner cylindrical contact within said housing;

a mass securely disposed at the end of said spring opposite said recess, extending axially from and into said end, and spaced from the end of said inner cylindrical contact beyond said outer tubular contact recess;

a flexible shroud having a closed end disposed snugly about the mass extending from said spring, said shroud extending axially about the length of said spring, and having an open end affixed sealably about the outer surface of said outer tubular contact and abutting the inner surface of the open end of said housing;

a fluid having a voltage controlled viscosity, said fluid occupying the space between said shroud and said housing; and a means extending through said housing and into said fluid for applying a voltage to said fluid.

13. The acceleration activated impact switch of claim 12 wherein said fluid having a voltage to controlled viscosity is a rheological fluid.

14. The acceleration activated impact switch of claim 13 wherein said means for applying a voltage to said fluid is a pair of spaced electrodes.

15. An acceleration activated impact switch, comprising:

an elongated housing having a longitudinal axis and two opposite enclosing ends normal to said longitudinal axis, one of said ends having a cylindrical opening centered about the longitudinal axis of said housing and the opposite end having two spaced openings;

a rigid tubular outer contact extending axially through the end of said housing having said centered cylindrical opening and sealably affixed thereto, the end of said contact inside said housing having a cylindrically shaped recess extending axially therein from said end;

an electrically insulative means for sealing the end of said tubular contact opposite the end having said recess, to said recess, said means having a centrally located cylindrical hole extending therethrough coincident with the longitudinal axis of said housing;

a rigid cylindrical inner contact extending sealably through said centrally located hole in said means for sealing, and extending coaxially through said outer contact and spaced therefrom by said means for sealing;

an electrically conductive spiral spring contact axially extending along and centered about the longitudinal axis of said housing one end of said spring affixed within and having electrical contact with the cylindrically shaped recess of said outer tubular contact, said spring extending from said recess coaxially about and beyond the end of said inner cylindrical contact, towards the opposite end of said housing;

a mass having one end cylindrically shaped, said end having a diameter greater than the diameter of said coiled spring contact, a shaped opposite end, and a cylindrical neck extending therebetween, said shaped opposite end extending into and spreading the coils of the end of said spring extending about and beyond the end of said inner cylindrical contact until the coils at the end of said spring return to their unspread condition about said neck and the shaped end of said mass is positioned by said spring in spaced relation with the facing end of said inner cylindrical contact;

an impervious, nonconductive, flexible shroud sized shroud having a closed end and an opposite open end, said shroud fitting down and around said mass and spring, said closed end fitting snugly upon and about the end of said mass not encircled by said spring, and the open end of said shroud extending down about the remainder of said mass and spring, the inner diameter of said open end sized to fit and sealably fitting about said outer tubular contact and abutting the inside of the end of said housing through which said inner and outer contacts extend;

a fluid having a viscosity which varies as a function of applied voltage, said fluid filling the space between said shroud and said elongated housing; and a means for applying a voltage to said fluid, said means extending from outside said housing sealably through said spaced openings in the opposite end of said housing from the end having said cylindrical opening, and into said fluid occupying the space between said shroud and said elongated housing.

16. The acceleration activated impact switch of claim 15 wherein said means for applying a voltage to said fluid is a pair of spaced electrodes.

17. The acceleration activated impact switch of claim 16 wherein said fluid having a viscosity which varies with voltage is a rheological fluid.

18. The acceleration activated impact switch of claim 17 where said shaped opposite end of said mass is a truncated cone having its base coincident with one side of said neck.

* * * * *